US008757914B1

(12) United States Patent
Megaro et al.

(10) Patent No.: US 8,757,914 B1
(45) Date of Patent: Jun. 24, 2014

(54) APPARATUS AND METHOD FOR DISPENSING A FLUID

(71) Applicants: Arianna Megaro, Chapel Hill, NC (US); Matthew Megaro, Chapel Hill, NC (US); Robert C. Williams, III, Raleigh, NC (US); Brad Forrest, Cary, NC (US); Matt Khare, Willow Spring, NC (US)

(72) Inventors: Arianna Megaro, Chapel Hill, NC (US); Matthew Megaro, Chapel Hill, NC (US); Robert C. Williams, III, Raleigh, NC (US); Brad Forrest, Cary, NC (US); Matt Khare, Willow Spring, NC (US)

(73) Assignee: BlokRok, Inc., Chapel Hill, NC (US)

( * ) Notice: Subject to any disclaimer, the term of this patent is extended or adjusted under 35 U.S.C. 154(b) by 0 days.

(21) Appl. No.: 13/833,813

(22) Filed: Mar. 15, 2013

(51) Int. Cl.
*B43M 11/06* (2006.01)

(52) U.S. Cl.
USPC ..... 401/219; 401/220; 401/218

(58) Field of Classification Search
USPC ..... 401/171, 176–182, 219–220, 147, 148, 401/150, 152, 155, 205, 206, 183–184, 186
See application file for complete search history.

(56) References Cited

U.S. PATENT DOCUMENTS

| | | | | | |
|---|---|---|---|---|---|
| 4,150,904 | A * | 4/1979 | Stewart | 401/186 |
| 4,569,612 | A | 2/1986 | Schwartzman et al. | |
| 4,669,637 | A * | 6/1987 | Fiocco | 222/187 |
| 4,812,071 | A | 3/1989 | Batra et al. | |
| 4,813,463 | A | 3/1989 | Lin | |
| 5,056,949 | A | 10/1991 | Petrillo | |
| 5,152,305 | A | 10/1992 | Niv | |
| 5,482,393 | A | 1/1996 | Sekiguchi et al. | |
| 5,516,223 | A | 5/1996 | Matz et al. | |
| 5,716,151 | A | 2/1998 | Satake | |
| 5,888,007 | A | 3/1999 | Nicoll et al. | |
| 5,899,624 | A * | 5/1999 | Thompson | 401/206 |
| 6,244,776 | B1 * | 6/2001 | Wiley | 401/208 |
| 6,505,986 | B1 * | 1/2003 | Oder | 401/183 |
| 6,682,246 | B2 * | 1/2004 | Reggiani | 401/264 |
| 6,729,788 | B2 | 5/2004 | Bouveresse | |
| 6,883,996 | B2 * | 4/2005 | Ishida | 401/206 |
| 7,101,106 | B1 | 9/2006 | Wiley | |
| 7,226,231 | B2 | 6/2007 | Py et al. | |
| 7,658,568 | B1 * | 2/2010 | Armstrong et al. | 401/206 |
| 8,262,592 | B1 | 9/2012 | Brooks et al. | |
| 2008/0145136 | A1 * | 6/2008 | Korper | 401/198 |
| 2011/0250008 | A1 | 10/2011 | Lim | |
| 2012/0321368 | A1 | 12/2012 | Lim | |

* cited by examiner

*Primary Examiner* — David Walczak
*Assistant Examiner* — Jennifer C Chiang
(74) *Attorney, Agent, or Firm* — Michael G. Johnston; Moore and Van Allen PLLC

(57) ABSTRACT

An apparatus for dispensing a fluid comprises a housing and a resilient liner adapted to hold the fluid disposed in the housing. A fluid transfer mechanism is in fluid communication between the liner and an applicator assembly mounted on the housing for dispensing the fluid on the skin of the user. The applicator assembly includes an actuator movable relative to the housing so as to activate the fluid transfer mechanism when the actuator is reciprocated. A fluid delivery element is held in contact against skin of a user for applying the fluid onto the skin. The fluid delivery element is supported on the actuator to be movable together with the actuator by varying contact pressure with the skin. Each movement of the actuator generates continuous negative pressure within the liner for drawing fluid through the fluid transfer mechanism and collapsing the liner.

22 Claims, 13 Drawing Sheets

APPARATUS AND METHOD FOR DISPENSING A FLUID

BACKGROUND

An apparatus and method for dispensing fluid is described and, more particularly, an apparatus and method for dispensing fluid on the skin.

Conventional hand held and manipulated fluid applicators for dispensing a lotion on the skin are numerous. In some applicators, a lotion supply mechanism is provided to deliver the lotion from a fluid storage container to the applicator that makes contact with the skin. In one embodiment, applicators have a squeezable fluid storage container connected to a roller-mounting applicator head which meters fluid from the container to a fluid absorbent dispensing roller or pad made of felt or other porous resilient material. This configuration is limited, however, to use with less viscous fluids, which are capable of passing through a porous member and are believed to be less well suited for applying more viscous fluids, such as sunscreen. Also, many applicators require the consumer to squeeze the entire volume of the container each time a small amount of fluid is desired while others require a repetitive and uncomfortable pumping to transfer fluid making such mechanisms tedious and uncomfortable to operate. Further, these applicators cannot be operated in an inverted position due to the need to maintain contact between the fluid and the supply mechanism. This inversion makes the applicator awkward and difficult in reaching certain areas of the body. In the case of conventional bottled lotion containers, these generally require the consumer to first pour fluid onto their palms and then spread the fluid onto their skin, a process that can be both tedious and messy and make it difficult to apply uniform layers of lotion. Finally, aerosol spray devices are used to deliver some lotions but these add cost and disposable waste while introducing the mess of overspray, the flammability danger of alcohol-based propellants, the inhalation risk of aerosolized micro particles and the inability to deliver more viscous skin protecting emollients.

For the foregoing reasons, there is a need for a new apparatus and method for dispensing a fluid. The new apparatus and method should provide fluid application to the skin in a faster, less messy, and more effective manner than conventional fluid delivery applicators.

SUMMARY

An apparatus for dispensing a fluid is provided. The fluid dispensing apparatus comprises a housing defining an open interior and a resilient liner adapted to hold the fluid, the liner configured to be at least partially disposed in the interior of the housing. A fluid transfer mechanism is in fluid communication with the liner, the fluid transfer mechanism configured to transfer the fluid from the liner. An applicator assembly is mounted on the housing in fluid communication with the fluid transfer mechanism for dispensing the fluid on the skin of the user. The applicator assembly includes an actuator movable relative to the housing in a first direction and a second direction so as to activate the fluid transfer mechanism to transfer the fluid from the liner to the applicator assembly when the actuator is reciprocated. A fluid delivery element is held in contact against skin of a user for applying the fluid onto the skin. The fluid delivery element is supported on the actuator to be movable together with the actuator by varying contact pressure with the skin. Each movement of the actuator in the second direction generates continuous negative pressure within the liner for drawing fluid through the fluid transfer mechanism and collapsing the liner.

A fluid transfer assembly is provided for use with an apparatus for dispensing a fluid, the fluid dispensing apparatus including a source of fluid and a reciprocating applicator assembly for dispensing the fluid on skin of a user. The fluid transfer assembly comprises a housing defining an interior cavity for accommodating the fluid, an end of the housing adapted to be in fluid communication with the source of fluid and having at least one opening for receiving the fluid. A piston member defines a through passage and is in fluid communication with the applicator assembly. The piston member is adapted to be operatively connected to the applicator assembly and reciprocally disposed in the housing for movement in a first direction toward the end of the housing and in a second opposite direction. The piston member and the housing define a variable volume chamber between the piston member and the end of the housing. Each movement of the piston member in the first direction reduces the volume of the variable volume chamber for generating positive pressure in the chamber and forcing fluid through the through passage in the piston member and to the applicator assembly. Each movement of the piston member in the second direction increases the volume of the variable volume chamber for generating negative pressure within the chamber for drawing fluid through the at least one opening in the end of the housing.

Also provided is a fluid applicator assembly for use with an apparatus for dispensing a fluid, the fluid dispensing apparatus including a source of fluid and a fluid transfer assembly in fluid communication with fluid source for delivering fluid to the fluid applicator assembly. The fluid applicator assembly comprises a tray member in fluid communication with the fluid transfer assembly. The tray member comprises a pair of spaced walls, each wall tapered to an outer edge surface for defining a recess for temporarily storing the fluid supplied from fluid transfer assembly. A roller assembly includes a roller rotatably mounted to the tray member for contacting skin of a user for applying the fluid onto the skin.

A method for dispensing a fluid is also described. The method comprises the steps of providing a fluid dispensing apparatus, including a housing defining an open interior and a resilient liner adapted to hold the fluid, the liner configured to be at least partially disposed in the interior of the housing. A fluid transfer mechanism is in fluid communication with the liner, the fluid transfer mechanism configured to transfer the fluid from the liner. An applicator assembly dispenses the fluid on the user's skin, the applicator assembly mounted on the housing in fluid communication with the fluid transfer mechanism. The applicator assembly includes an actuator movable relative to the housing in a first direction and a second direction so as to activate the fluid transfer mechanism to transfer the fluid from the liner to the applicator assembly when the actuator is reciprocated, and a fluid delivery element which is held in contact against skin of a user for applying the fluid onto the skin, the fluid delivery element supported on the actuator to be movable together with the actuator by varying contact pressure with the skin. The next steps are contacting the skin of a user with the fluid delivery element, pressing the fluid delivery element against the skin of the user for moving the actuator in the first direction, and releasing pressure of the fluid delivery element against the skin of the user for allowing the actuator to move in the second direction generating continuous negative pressure within the liner for drawing fluid through the fluid transfer mechanism and collapsing the liner.

BRIEF DESCRIPTION OF THE DRAWINGS

For a more complete understanding of the present invention, reference should now be had to the embodiments shown in the accompanying drawings and described below. In the drawings.

DESCRIPTION

Certain terminology is used herein for convenience only and is not to be taken as a limiting. For example, words such as "upper," "lower," "left," "right," "horizontal," "vertical," "upward," "downward," "top" and "bottom" merely describe the configurations shown in the FIGs. Indeed, the components may be oriented in any direction and the terminology, therefore, should be understood as encompassing such variations unless specified otherwise. The words "interior" and "exterior" refer to directions toward and away from, respectively, the geometric center of the core and designated parts thereof. The terminology includes the words specifically mentioned above, derivatives thereof and words of similar import.

Figure 1:
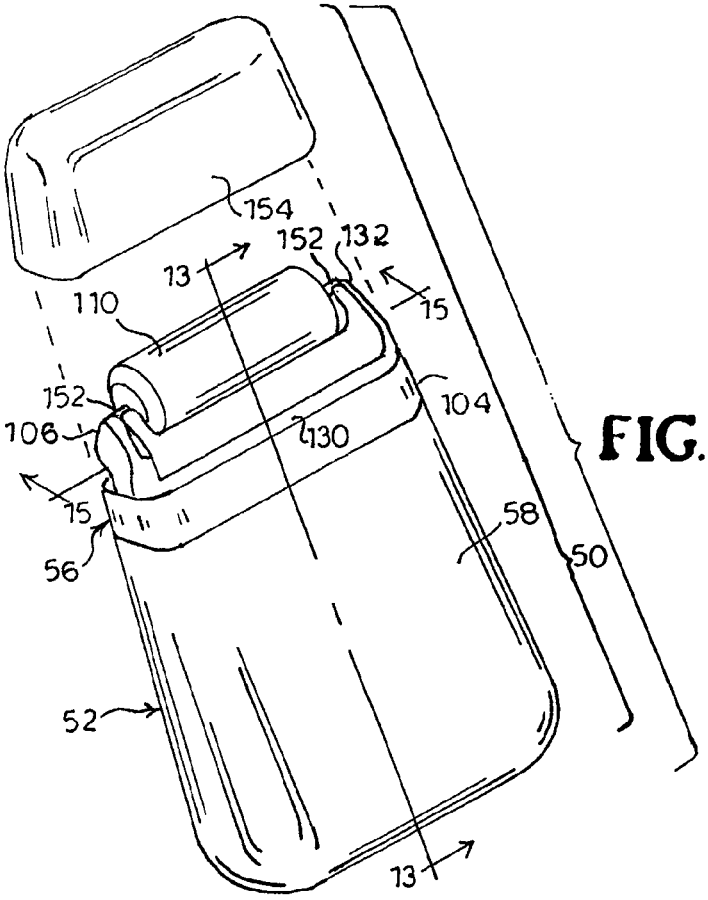
FIG. 1 is a perspective view of an embodiment of an apparatus for dispensing fluid.
Figure 2:
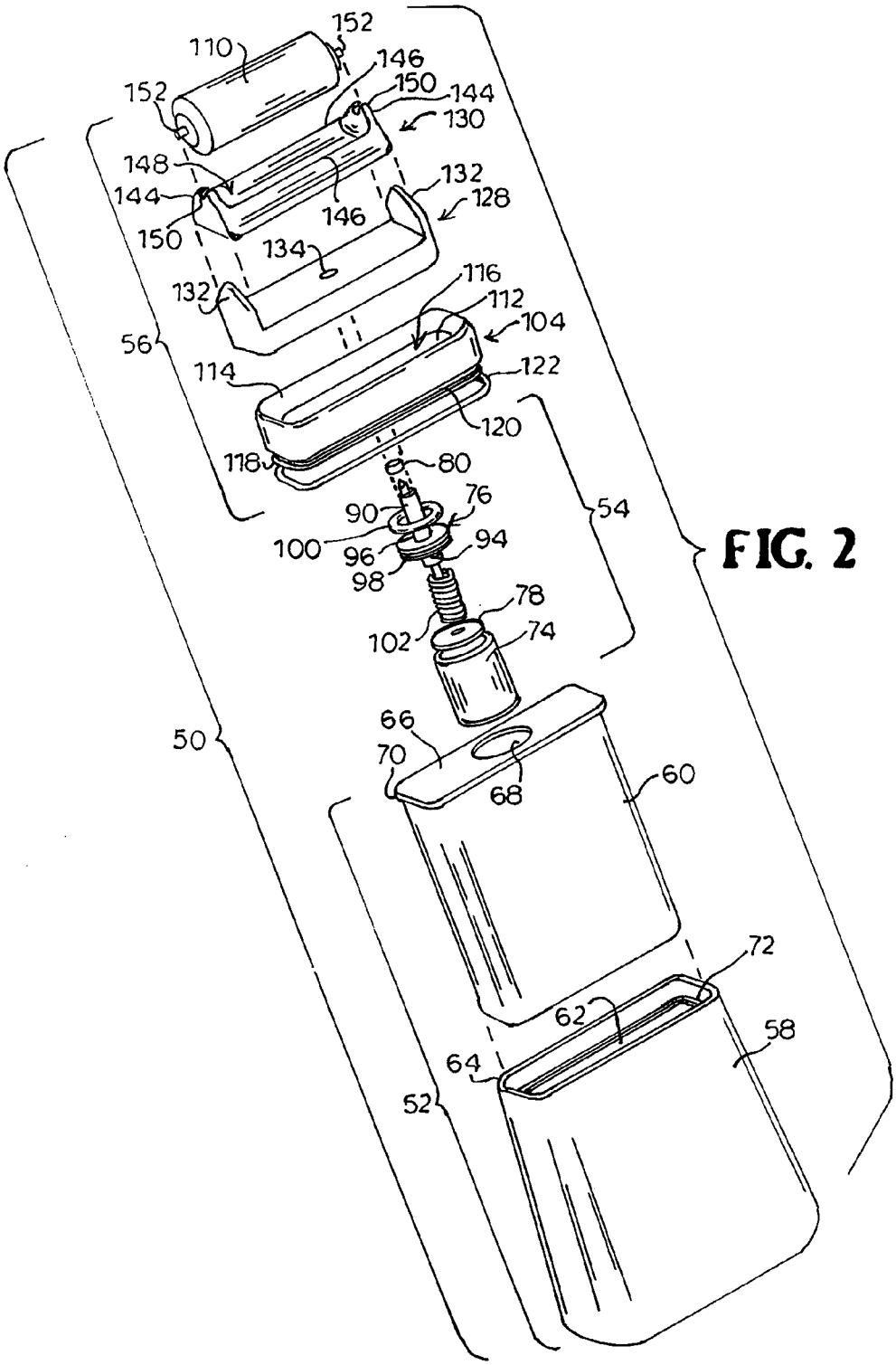
FIG. 2 is an exploded perspective view of the fluid dispensing apparatus as shown in FIG. 1.

Referring now to the drawings, wherein like reference numerals designate corresponding or similar elements throughout the several views, an apparatus for dispensing a fluid is shown in FIGS. 1 and 2 and generally designated at 50. The fluid dispensing apparatus 50 is a hand-held dispenser comprising a reservoir assembly 52 for accommodating a fluid, a pump assembly 54 in fluid communication with the reservoir assembly, and an applicator assembly 56 in fluid communication with the pump assembly for applying the fluid on a surface, such as skin of a human body.

The reservoir assembly 52 comprises a housing 58 and a liner 60 for the housing. The housing 58 is a substantially hollow member defining an interior cavity 62 having an open outer end 64. As shown in FIGS. 1 and 2, the housing 58 may be a trapezoid shape. It is understood, however, that the housing 58 can be any geometric shape, including, for example, square, rectangular, oval, circular, conical, cylindrical and combinations and variations of these, including irregular patterns. The shape of the housing 58 may be selected based on considerations of ergonomics, performance, cost of production, safety and security. The shape of the housing 58 should also consider ease of fabrication, for example, by various methods from plastic and metal. In the present embodiment, the trapezoid shape has sides that taper inwardly toward the outer end 64 of the housing 58. This configuration offers a natural grip for stability in the hand of a user. The exterior edges of the housing 58 may be rounded such that the housing fits comfortably and securely in the palm of the hand. Various contouring is also contemplated to enhance user performance.

The dimensions of the housing 58 may vary depending on desired fluid volume to be contained within the housing, as well as certain desired performance attributes. For example, a larger, longer housing 58 may extend the reach of a user during use, whereas a smaller housing will reduce the contained fluid volume, but enable easy storage, such as in a pocket.

The housing 58 may be formed from rigid or semi-rigid polymers, including, but not limited to, delrin, Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof. In some embodiments, the housing 58 may comprise metal, such as die cast metal, or have metal inserts to increase the strength of the housing. The preferred thickness of the material of the housing 58 should be sufficient to withstand impact on a hard surface when dropped and will depend on the material itself. It is understood that the housing 58 is not intended to be limited by the materials listed here, but may be carried out using any suitable synthetic or natural material which allows the construction and use of the apparatus described herein and sufficient to meet strength, weight, and other desired characteristics.

The exterior surface of the housing 58 may be designed to enhance appearance and performance. For example, a textured exterior surface can aid the user in gripping the housing 58, especially if fluid is on the exterior surface or the hand. Further, the exterior surface may be designed to enhance gripping during the operation of not only squeezing but also pressing the container's applicator assembly against the surface on which the liquid is to be applied. Accordingly, the exterior surface of the housing 58 may have features to enhance grip and to aid in control of the housing during fluid application, including, but not limited to, dimples, indentations, finger grips, slots, channels, protrusions, ridges, bumps, and the like, or any combination thereof. The features of the exterior surface of the housing 58 may be formed of materials desirable to the intended use, including requirements of durability, washability, UV resistance, water and heat resistance and impact resistance. Still further exterior features include camouflage for military and hunting applications or the addition of an elastomer or rubber to enhance the gripping capability. As shown in FIG. 1, the housing 58 may also have a slot or other anchoring point to permit the attachment of a carrying lanyard.

In another embodiment, the housing 58 may be a disposable container made in a known manner of a pliant injection molded plastic material such that fluid may be dispensed by manually squeezing, and thus compressing, the side walls of housing. In still another embodiment, the housing 58 may be made of a clear or partially transparent material that will provide the means to visually ascertain the level of fluid remaining in the liner 60.

The liner 60 is a flexible, resilient pouch for holding the fluid to be dispensed. The liner 60 has a top wall 66 defining a circular opening 68 into the interior of the pouch. The liner 60 is adapted to be received within the cavity 62 of the housing 58 such that the liner is at least partially disposed within the housing. As seen in FIG. 2, the liner 60 can be provided with a flange 70 extending outwardly from the periphery of the top wall 66. The outer end 64 of the housing 58 has a shoulder 72 formed along the inside of the edge of the housing 58 for receiving the flange 70 of the liner 60.

A particular performance attribute of the liner 60 is that it collapses as it is depleted of fluid, without permitting air to fill the void created by the depleted fluid. This attribute enables the fluid in the liner to remain in constant contact with the pressurization chamber, irrespective of the relative position of the applicator during use. Accordingly, the applicator will operate at any angle of use, a particularly useful feature for applying sunscreen or other fluids to surfaces that are above the level of the user's hand as the user holds the applicator during use.

Still another attribute of the liner 60 is that it enables the transfer of fluid by responding to a relative vacuum generated by the pump assembly 54. Accordingly, the liner 60 does not need to be under positive pressure and has neutral pressure while not in use, reducing the risk of fluid leakage at seams, holes or other opening that are in contact with the liner, such as the point of connection between the housing 58 and the applicator assembly 56.

In one embodiment, the liner 60 is sized and shaped to fit snugly within the housing 58. The interior of the housing 58 is shaped to retain the liner 60 and limit slippage and bunching of the liner, which may include beveled corners and other irregular forms that can better hold the liner in position during use and refilling. The flexibility and resiliency of the material of the liner 60 allows the liner to conform to the interior of the housing 58 to maximize the amount of fluid that can be stored within the housing. The interior of the housing 58 may further comprise a textured surface or added lubrication to assist in the placement and removal of the liner 60, or to allow the liner to change shape in reaction to the addition or removal of fluid.

In another embodiment, the liner 60 may have the additional feature of a second opening that permits the liner to be refilled through a separate portal passing through the exterior housing and without having to remove the applicator assembly 56. This additional portal may be formed with a threaded plug, or other sealable closure elements, that permits for the portal to be readily opened and closed from the exterior of the housing 58.

In another embodiment, the liner 60 may have lateral creases or accordion folds (not shown) that enable the liner to collapse beginning at one end of the liner, preferably the end distal to the pump assembly 54, until it is fully depleted. This operation will provide a visual indication to the user as to the degree to which the liner 60 is depleted and thus the amount of fluid remaining.

The material of the liner 60 may be clear or translucent, which will enable the user to determine the amount of fluid in the liner during use or filling. It is understood that in this embodiment, the housing 58 may also be formed from transparent or translucent material. In another embodiment, the material of the liner 60 may be opaque or of a composition that shield the contents from UV light for use, for example, with photosensitive fluids such as, for example, sunscreen. The liner color, along with symbols, logos, and other markings (not shown), will also enable the user to readily identify the specific contents of a given liner 60 without foreknowledge of its contents and without removing the liner from the applicator The liner 60 is removable for cleaning, refilling or replacement. The user can also fill the liner 60 while the liner is in the housing 58. In this method, the housing 58 provides rigidity and stability to the liner 60 during filling. An indicator (not shown) may be provided on the liner 60 to identify a maximum fill level to reduce spills during filling.

In another embodiment, prefilled liners may also be provided for replacement of a spent liner 60. A prefilled liner would permit branding and labeling of the fluid such that the user would know the content of the liner. Prefilled liners could then be sold separately as a disposable item. A prefilled liner would incorporate a sealing method that allows the user to quickly peel off a seal before replacing the liner, or the liner 60 may incorporate a membrane seal that is punctured during insertion, thereby accessing the fluid for use. Prefilled liners 60 would have features that secure the liner, align it within the housing 58 and allow it to form a seal.

The pump assembly 54 provides a means for drawing fluid from the reservoir assembly 52 and delivering the fluid to the applicator assembly 56 for dispensing the fluid. The pump assembly 54 comprises a pressurization chamber 74 for temporarily storing fluid received from the reservoir assembly 52, a piston member 76, an inlet valve 78 for permitting fluid to be drawn into the pressurization chamber 74 from the reservoir assembly 52, and an outlet valve 80 permitting the fluid to be delivered from the pressurization chamber 74 to the applicator assembly 56. As described herein below, the pump assembly 54 is actuated for drawing fluid from the reservoir assembly 52, pressurizing the fluid within the pressurization chamber 74, and delivering the fluid to the applicator assembly 56.

Figure 3:
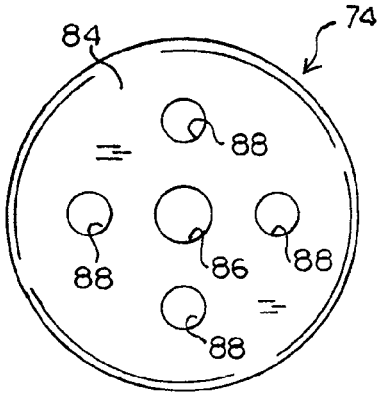
FIG. 3 is a transverse cross-section view of an embodiment of a pressurization chamber for use in the fluid dispensing apparatus as shown in FIG. 1.
Figure 12B:
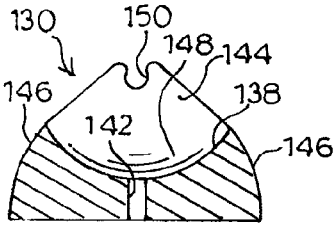
FIG. 12B is a transverse cross-section view of the tray member as shown in FIG. 10.

The pressurization chamber 74 is a hollow, cylindrical tube defining an interior chamber 82 closed at an inner end 84. As seen in FIG. 3, the closed inner end 84 of the pressurization chamber 74 defines a central axial opening 86 and a plurality of fluid intake ports 88 radially spaced from the central axial opening. The pressurization chamber 74 is sized and shaped based on the space limitations of the reservoir assembly 52 and the desired amount of fluid to be discharged in a single activation of the applicator. The embodiment of the pressurization chamber 74 shown in the FIGs. is just one example, and it is understood that the pressurization chamber may be configured in any suitable shape. The interior chamber 82 of the pressurization chamber 74 is adapted to meet preferred fluid delivery volume requirements or other performance needs. A larger chamber 82 will require a higher positive pressure input for actuation by the user and will reduce the relative fluid storage capacity of the reservoir assembly 52. A smaller chamber 82 will deliver less fluid per actuation, but will require less actuation pressure, a desirable feature for some applications where less applicator pressure on the application surface is conducive to operator control and comfort. For example, a chamber volume of 0.066 oz. delivers a sufficient fluid volume of 0.033 oz. The pressurization chamber 74 is readily modifiable to transfer larger or smaller fluid volumes. The configuration of the pressurization chamber 74 delivers lotions with viscosities typical for a range of hand applied sunscreens, lotions, balms, and other skin care products. The pressurization chamber dimensions, fluid transfer ports, valve flow rates and springs may be modified to be adapted to other fluids with greater or lesser relative viscosity.

The piston member 76 is an elongated rod having an inner portion 89 and a hollow outer portion 90 open at an outer end 91. The piston member 76 has at least one port 94 opening into the interior of the outer portion 90. A circular piston head 96 extends normally from the perimeter of the piston member 76 intermediate its length. The diameter of the piston head 96 corresponds to the diameter of the interior of the pressurization chamber 74. The piston head 96 may have a circumferential groove 98 for receiving an o-ring 100 for sealing engagement of the piston head against the wall of the pressurization chamber 74. Alternatively, the piston head 96 may be of sufficiently accurate tolerance to form a seal to the inner wall of the pressurization chamber 74

The piston head 96 may have a flat surface or may have a concave or convex surface. The piston member 76 is at least partially disposed in the pressurization chamber 74. In a home position of the piston member 76, the inner portion 89 extends at least partially into the central axial opening 86 in the inner end 84 of the pressurization chamber 74. A circular stop valve 78 is disposed at the inner end of the pressurization chamber 74 and defines a central opening for passing the inner portion 89 of the piston member 76. The diameter of the stop valve 78 is the same as the interior diameter of the pressurization chamber 74. The stop valve 78 is in sealing contact with the bottom wall of the pressurization chamber 74 such that a fluid path from the liner 60 via the intake ports 88 is normally closed by the stop valve 78. The piston member 76 is biased outwardly toward the home position by means of a coil spring 102 interposed between the piston head 96 and the bottom wall of the pressurization chamber 74. The spring 102 also serves to hold the stop valve 78 in place. It is understood that other loading springs may be suitable for the fluid dispensing apparatus 50, such as leaf, volute, or torsion springs. The inner portion 89 of the piston member 76 is sized so that the piston member can reciprocate axially relative to the pressurization chamber 74 and the stop valve 78 when the pump assembly 54 is actuated. Axial movement of the piston member 76 is guided by confined movement of the inner portion 89 in the central axial opening 86. This arrangement increases the stability of the mechanism of the pump assembly 54 during use.

A one-way valve 80 is provided at the outer end 91 of piston member 76. In the embodiment shown in FIGS. 1 and 2, the one-way valve 80 is a duckbill valve. A press fit collar or a molded undercut holds the duckbill valve 80 in position on the piston member 76. The flat end of the duckbill valve 80 is configured to open in response to positive pressure in the pressurization chamber 74 allowing fluid to pass from the pressurization chamber. When pressure is removed, or there is negative pressure in the pressurization chamber 74, the duckbill valve 80 closes preventing fluid backflow, including air, from entering the pressurization chamber 74. It is understood that other one-way valves may be suitable for use in the fluid dispensing apparatus 50, including, but not limited to, ball check valves, umbrella valves, swing check valves or tilting disc check valves, stop-check valves, lift-check valves and the like.

The applicator assembly 56 comprises various components that are integrated to enhance the rapid delivery of large liquid volumes. In this regard, the applicator assembly 56 receives fluid, distributes it into position for uptake on the applicator head, minimizes excessive fluid flow that may lead to leaks and spills, applies a uniform coating of liquid while at the same time enables the transfer of pressure that enables the operation of the pressurization chamber. In particular, the applicator assembly 56 performs these operations while enabling the user to regulate variably the rate at which fluid is delivered to the application surface by varying the amount of pressure applied to the applicator on the delivery surface. Notably, the user may choose to apply little pressure so as to stop the flow of liquid, as may be desirable in instances where the user wishes to operate the applicator on the application surface to manage the liquid that is already applied, without delivering additional fluid at that moment.

Figure 4:
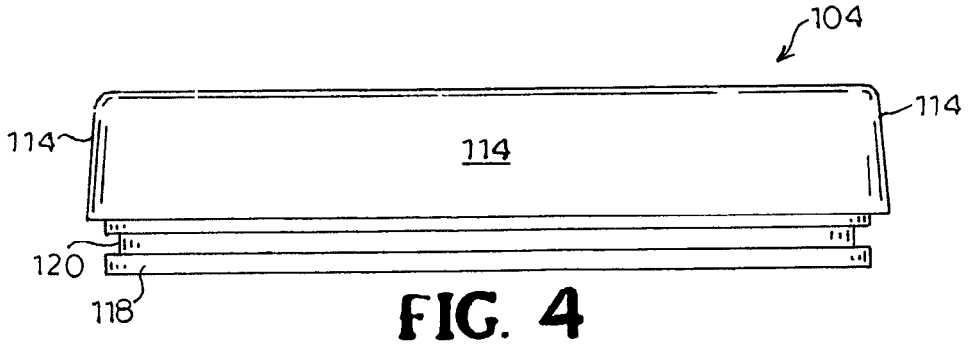
FIG. 4 is an elevation view of an embodiment of a top plate for use in the fluid dispensing apparatus as shown in FIG. 1.
Figure 5A:
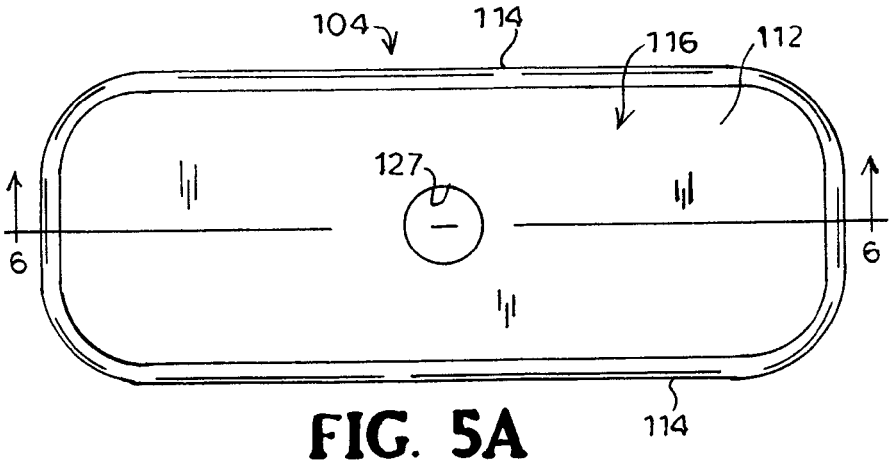
FIG. 5A is a top plan view of the top plate as shown in FIG. 4.
Figure 5B:
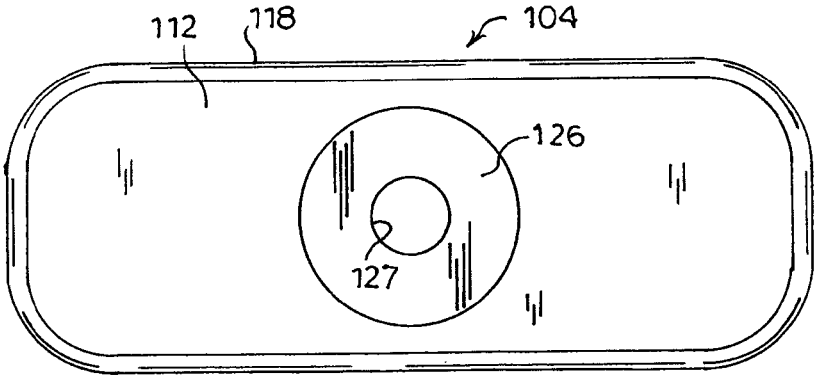
FIG. 5B is a bottom plan view of the top plate as shown in FIG. 4.

The applicator assembly 56 comprises a top plate 104, a fluid upload tray 106 and a roller head assembly 108, including a roller 110. The applicator assembly 56 receives and transmits fluid from the pump assembly 54 to the roller 110. Referring to FIGS. 4-5B, the top plate 104 includes a base member 112 and integral peripheral walls 114 extending outwardly from the base member. The base member 112 and peripheral walls 114 define a cavity 116 for slidingly receiving the upload tray 106 for reciprocation of the upload tray with respect to the top plate 104. The top plate 104 has a flange 118 depending inwardly from the base member 112. The outer surface of the flange 118 defines a peripheral groove 120 for receiving a ring seal 122. The ring seal 122 can be, for example, an O-ring or a quad-ring which provides extra sealing force. The top plate 104 fits snugly onto the housing 58 with the flange 118 received in the outer end 64 of the housing. The ring seal 122 on the exterior of the flange 118 provides sealing engagement with the inner surface of the housing 58. As seen in the FIGS. 13 and 14, the top plate 104 captures the flange 70 of the liner 60 against the shoulder 72 at the outer end of the housing 58.

Figure 6:
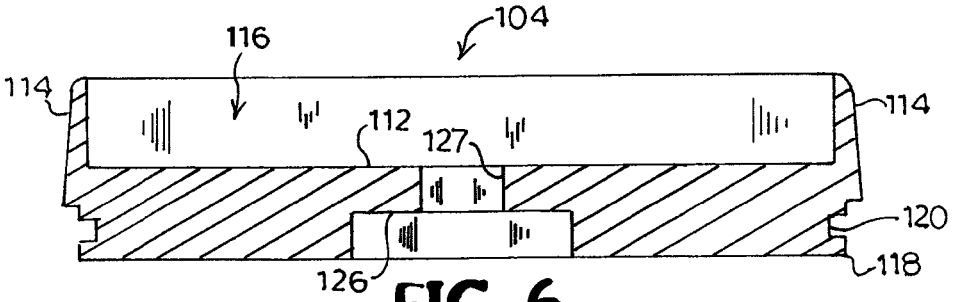
FIG. 6 is a longitudinal cross-section view of the top plate as shown in FIG. 4.

The inner surface of the base member 112 of the top plate 104 defines a central axial bore 126 (FIG. 6) for receiving the outer end of the pressurization chamber 74. An interference fit or a snap fit into the bore 126 may be provided for the pressurization chamber 74. Alternatively, the bore 126 may be internally threaded, for cylindrical configurations as shown, for removable threaded attachment of the pressurization chamber 74 within the bore 126. A more permanent attachment alternative includes gluing or welding the pressurization chamber 74 in the bore 126. The base member 112 of the top plate 104 also has a central port 127 opening into the bore 126. The port 127 is sized to pass the outer portion 90 of the piston member 76.

The upload tray 106 comprises an inner support member 128 and an outer tray member 130 (FIG. 2). Although the inner support member 128 and the outer tray member 130 of the upload tray 106 are depicted here as separate pieces, they could be combined in a single part depending on the manufacturing process employed. The upload tray 106 is configured as a floating bed and is actuated in cooperation with the pump assembly 54 to deliver fluid from the pressurization chamber 74 through the interior of the outer portion 90 of the piston member 76 to the outer tray member 130.

Figure 7:
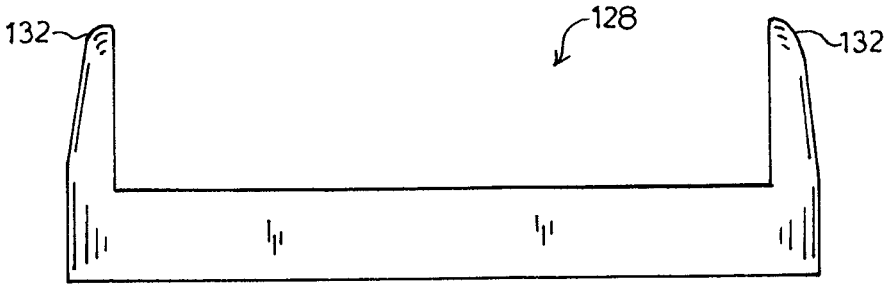
FIG. 7 is an elevation view of an embodiment of a support member for use in the fluid dispensing apparatus as shown in FIG. 1.
Figure 8A:
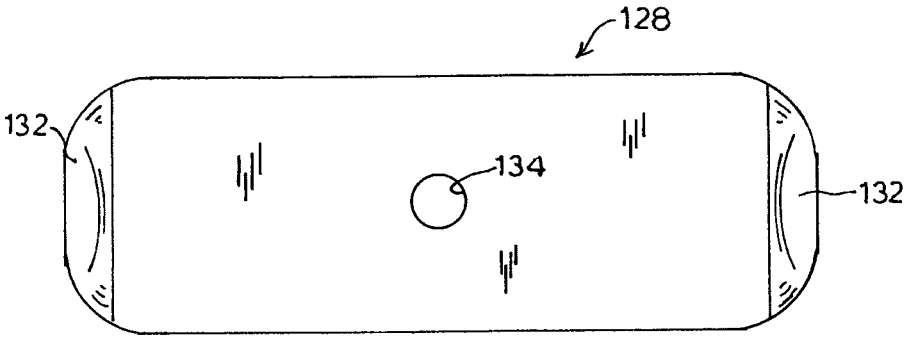
FIG. 8A is a top plan view of the support member as shown in FIG. 7.
Figure 8B:
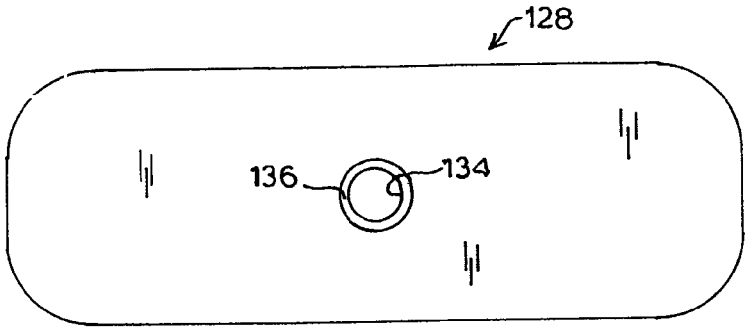
FIG. 8B is a bottom plan view of the support member as shown in FIG. 7.
Figure 9:
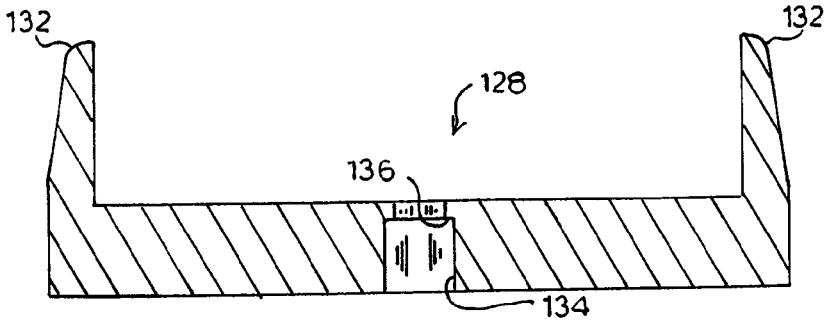
FIG. 9 is a longitudinal cross-section view of the support member as shown in FIG. 7.
Figure 10:
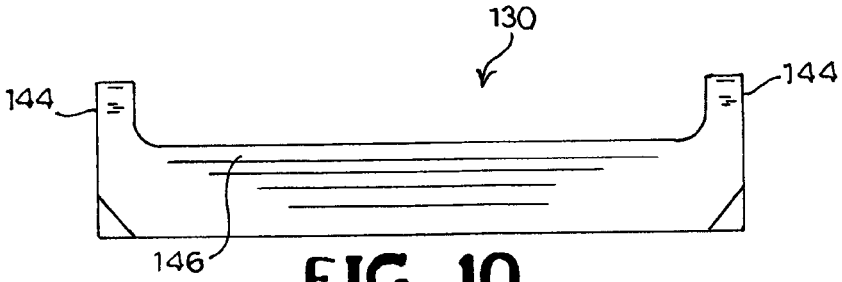
FIG. 10 is an elevation view of an embodiment of a tray member for use in the fluid dispensing apparatus as shown in FIG. 1.
Figure 11A:
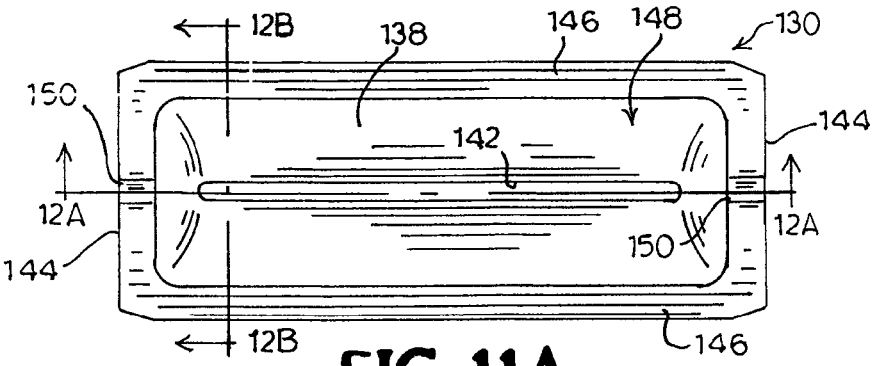
FIG. 11A is a top plan view of the tray member as shown in FIG. 10.
Figure 11B:
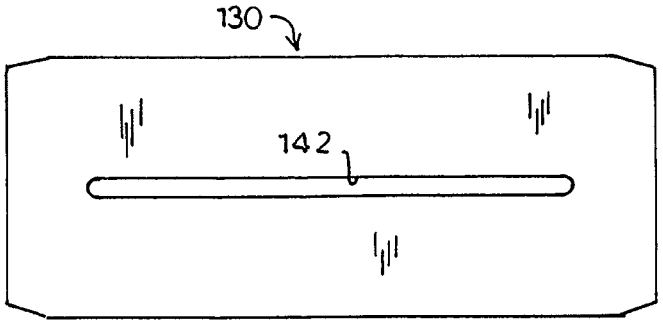
FIG. 11B is a bottom plan view of the tray member as shown in FIG. 10.
Figure 12A:
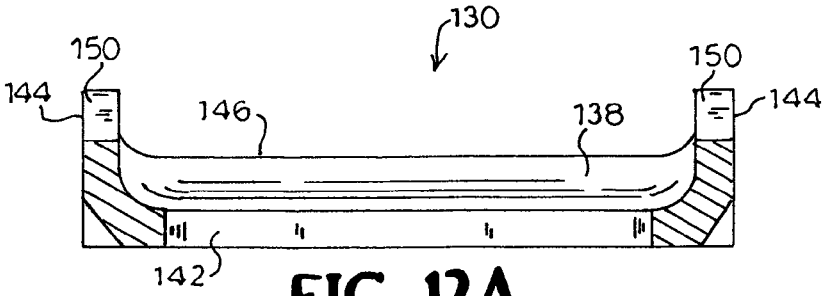
FIG. 12A is a longitudinal cross-section view of the tray member as shown in FIG. 10.
Figure 13:
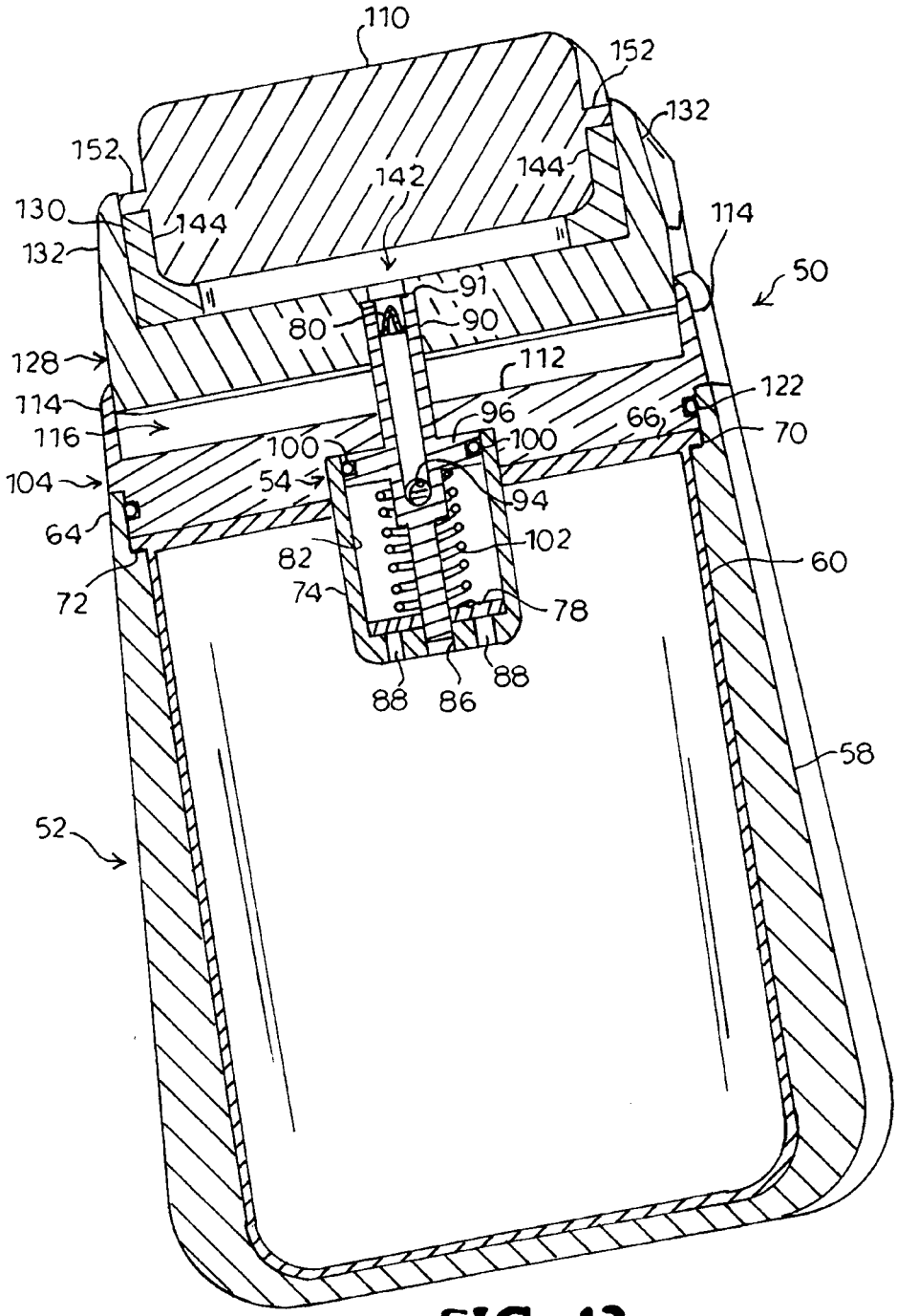
FIG. 13 is a longitudinal cross-section of the fluid dispensing apparatus as shown in FIG. 1 in a first position.
Figure 14:
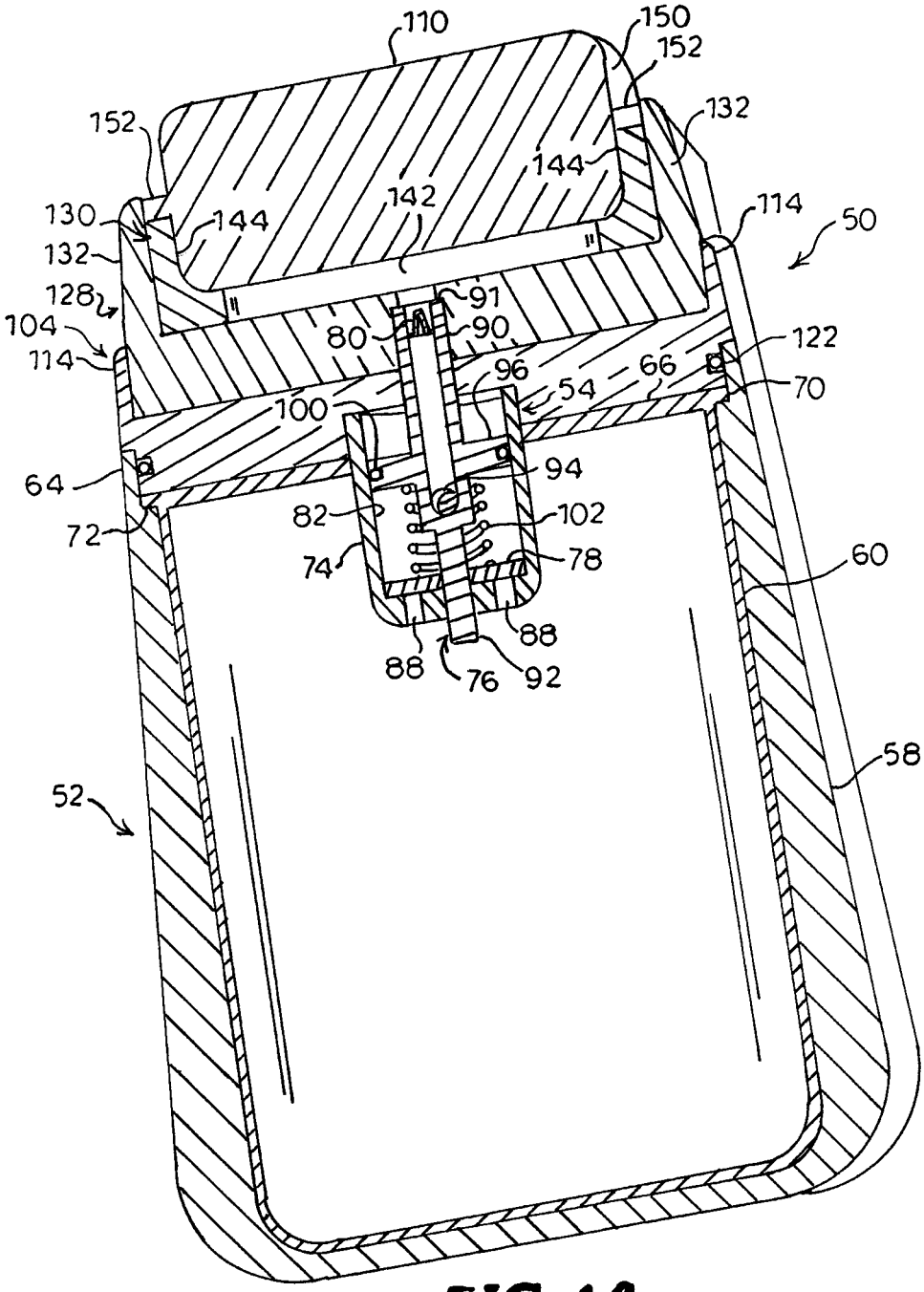
FIG. 14 is a longitudinal cross-section of the fluid dispensing apparatus as shown in FIG. 13 in a second position.
Figure 15:
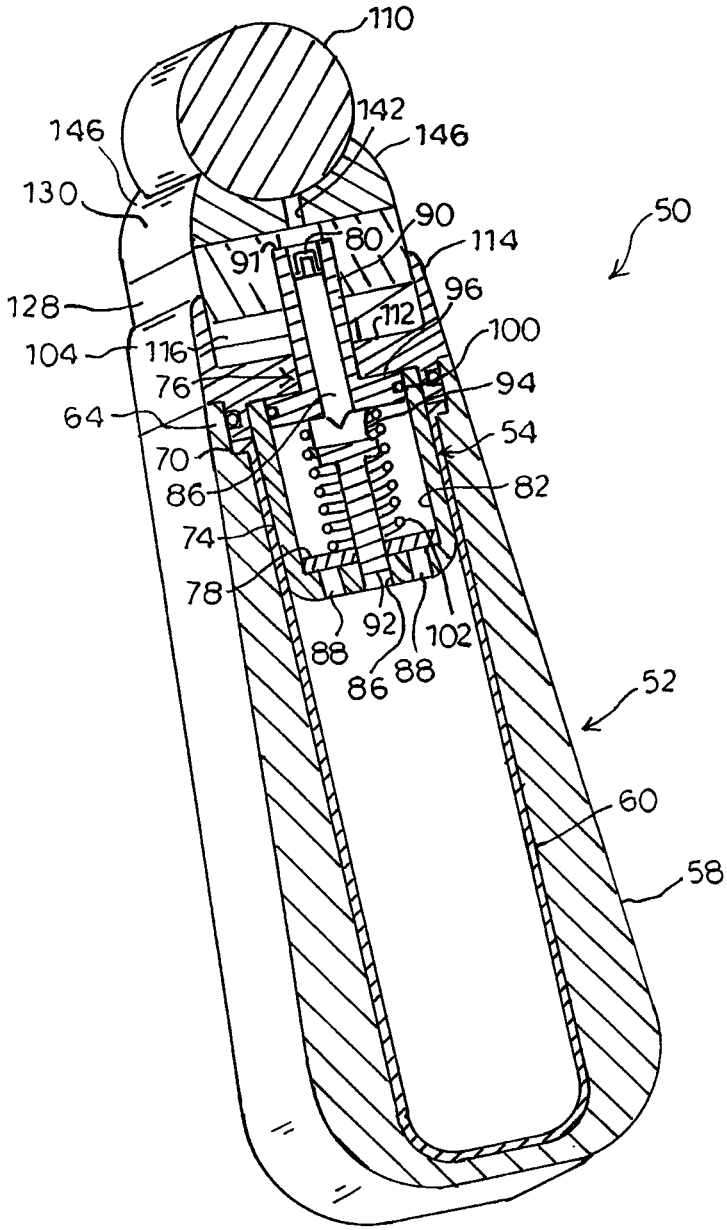
FIG. 15 is a transverse cross-section of the fluid dispensing apparatus as shown in FIG. 13.

Referring to FIGS. 7-9, the inner support member 128 is a generally planar component having outwardly extending legs 132 at each end. The support member 128 defines a central opening 134 wherein the diameter of the outer end of the opening is reduced forming an interior shoulder 136. The support member 128 is configured to slidingly fit within the cavity 116 of the top plate 104. As seen in FIGS. 2, 13 and 14, the central opening 134 of the support member 128 is adapted to receive the outer end 91 of the piston member 76. The outer end 91 of the piston member 76 may be press fit into the opening 134 and seat against the shoulder 136. In this arrangement, the upload tray 106 is in fluid communication with fluid in the liner 60 via the piston member 76. Referring to FIGS. 10-12B, the outer tray member 130 is a generally planar component having a concave outer surface 138. The outer tray member 130 has outwardly projecting end walls 144 and spaced sidewalls 146 which interconnect the end walls. The end walls 144 and sidewalls 146 of the outer tray member 130 together with the concave outer surface 138 define an elongated recess 148. The outer surface 138 of the tray member 130 defines a central channel 142 opening into the recess 148 and extending transversely along a midline from the outlet port 140 substantially over the entire length of the outer tray member 130. The outer tray member 130 is configured to fit snugly against the surface of the support member 128 between the legs 132.

In another embodiment (not shown), a plurality of fluid dispensing ports may be provided in the upload tray 106 in a predetermined spacing, locations and sizes to deliver fluid to the roller 110. The dispensing ports may be in a generally linear array between the end walls 144 with an internal manifold passage supplying each of the ports with fluid at a generally equal pressure. The size of the ports is selected to render the fluid dispensing apparatus 50 suitable for dispensing viscous fluids, such as sunscreen and bodily lotions.

The components of the applicator assembly 56 may be injection molded from a semi-rigid polymeric material, such as high impact polystyrene. It is understood that suitable components may be molded from other semi-rigid polymers or a resilient polymeric material. The applicator assembly may be molded from a thermoplastic elastomer, such as TPE (thermoplastic elastomers). However, other resilient materials may be used including, but not limited to silicone, natural rubber, latex rubber, butyl rubber, nitrile rubber, or metal. It is understood that the scope of the fluid dispensing apparatus is not intended to be limited by the materials listed here, but may be carried out using any material which allows the construction and operation of the fluid dispensing apparatus described herein.

As shown in FIGS. 1 and 2, the roller 110 comprises an elongated cylindrical roller. In this embodiment, the roller 110 provides rapid uniform delivery of fluid over large areas of skin. The roller 110 is supported by the outer tray member 130. The end walls 144 have opposed journal apertures 150. The roller 110 includes axle projections 152 on the ends of the roller 110 that rotatably engage the corresponding apertures 150 allowing for rotatable attachment of the roller 110 in the recess 148 of the outer tray member 130. The end walls 144 or the roller 110 may be sufficiently resilient to allow deformation so that the axle projections 152 engage or disengage with the upload tray member 130.

The upload tray assembly 106 and the roller 110 are movable together relative to the housing 58 so as to be capable of being depressed inwardly against the bias of the spring 102 of the pump assembly 54 as a consequence of the user pressing the roller 110 inward, for example, against the skin. This actuates the pump assembly 54 for supplying fluid with the roller 110 in rolling contact with the skin for dispensing fluid onto the skin. With this arrangement, the user is only required to bring the roller 110 in contact with the skin and apply pressure to actuate the pump assembly 54 for transferring the fluid to the upload tray 106 each time the applicator assembly 56 is depressed. The applicator assembly 56 performs the dual function of both actuating the pump assembly 54 while also dispersing the fluid in a controlled manner necessary to achieve the uniform coverage desirable in some applications.

In one embodiment, the roller 110 may have a textured surface. The textured surface may be provided by grooves or projections of different sizes, shapes and geometries. The grooves or projections may also have different patterns or may be oriented at different angles with respect to the longitudinal axis of the roller, such as in a zigzag, chevron, herringbone, hex, dot, or checkerboard patterns. In particular, the grooves may have a depth of about 0.005" to 0.05" for hard surface rollers and 0.005" to 0.25" for pliable surfaces. The projections may represent raised areas spaced apart or interconnected to define one or more open channels. The projections can be in the form of nubs or fin segments that are arranged in rows oriented generally parallel to the blades or spaced fin segments that are arranged both parallel to and perpendicular to the blades. Whether using grooves or projections, and without being bound by theory, it is believed the textured roller 110 will pick up a volume of fluid from the tray member 130. The textured surface also provides traction on the skin to allow the roller 110 to roll and not slide on the skin. The latter causes smearing of fluid, whereas rolling application spreads fluid evenly.

A non-porous, rigid roller 110 surface is preferred. In another embodiment, the roller 110 may be made of a synthetic or natural material suitable for absorbing fluid and dispensing the fluid upon surfaces against which the roller is rolled. A non-porous roller with a firm surface is preferred as it minimizes wear, clogging, smearing or slipping. Further, it is understood that the roller 110 as a fluid application member can be any rotatable element, such as a generally toroidal element. For example, a rotary ball applicator may be used to dispense fluid. The rotary ball is normally biased against a spring member via an elongated biasing element to prevent dispensing of the fluid.

In an alternate embodiment, a flexible sleeve can be mounted on a solid roller core (not shown). Such a configuration provides a pliable surface of the flexible sleeve to make contact with skin while retaining the rigid core foundation to enable the actuation of the pump assembly 54. The flexible sleeve can have any particular surface texture as demanded by the particular liquid application demand. A cupped surface is preferred since it can effectively collect fluid from the upload tray 106 while effectively delivering the fluid as the flexible surface comes into contact with the skin, deforms at its surface and releases the fluid as desired on the skin contact point. It is anticipated that instead of an attachable flexible sleeve, a similar result can be achieved by affixing a flexible material onto the exterior of the rigid core. This over molded surface can incorporate a range of surface textures including a cupped, ridged, channeled surface, or combination of these patterns.

In yet another embodiment, a fluid application member may comprise a rigid blade member (not shown). The blade member has at least one aperture that is in fluid communication with the pressurization chamber 74 for dispensing fluid on the skin. The body of the blade member tapers to an edge laterally along its length, providing a beveled surface amenable to spreading fluid as the blade is rapidly passed along the skin surface. In this embodiment, the blade member constitutes the actuator that is supported on the upload tray 106 to be movable relative to the reservoir assembly 52 for actuating the pump assembly 54 each time the blade member is pressed against and released from the skin for delivering fluid.

Figure 17:
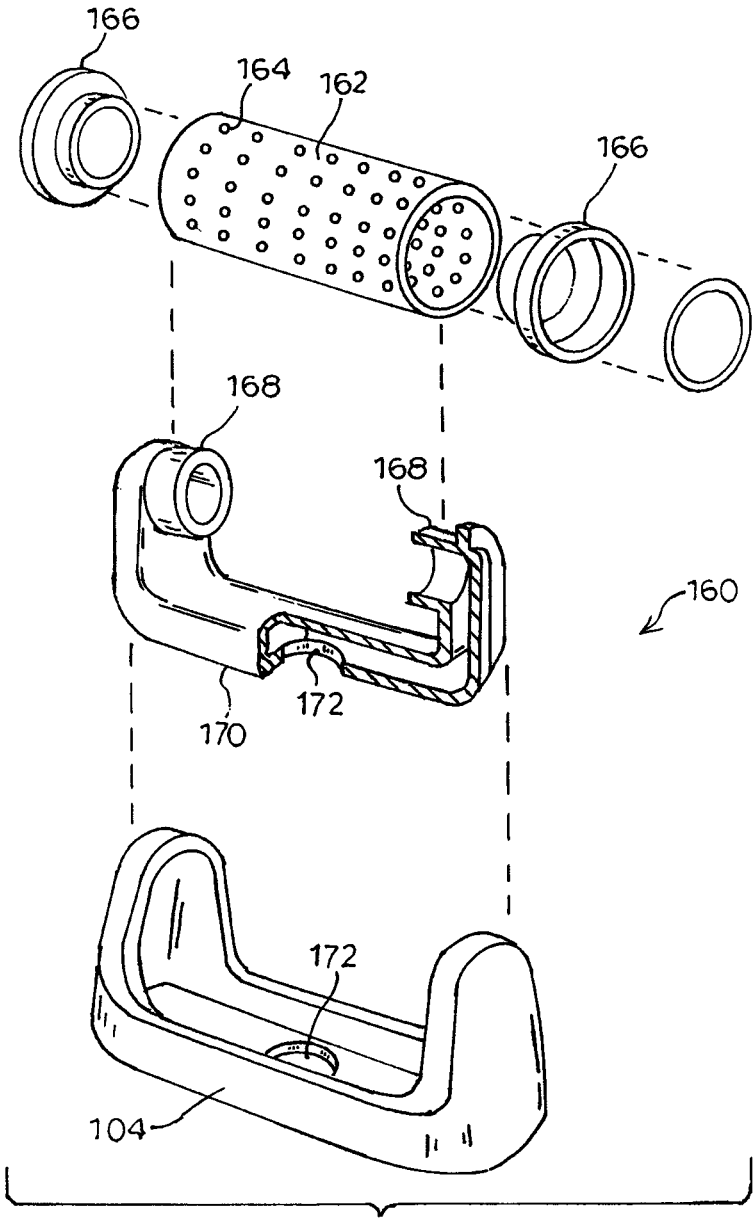
FIG. 17 is an exploded perspective view of an embodiment of a roller assembly for use in the fluid dispensing apparatus as shown in FIG. 1.

Another embodiment of the applicator assembly 56 is shown in FIG. 17 and generally designated at 160. In this embodiment, a roller 162 is sufficiently porous to allow fluid to be transferred under pressure from a hollow interior of the roller 162 to an exterior surface for application onto skin. Such porosity is provided by holes 164 that act as tubes for transferring fluid from the interior to the exterior, or by using mesh, foam or other materials that permit the transfer of pressurized fluid. The roller 162 rotates on axles 166 that are hollow and connect to the vertical support stanchions 168 rising from the support tray 170. The support stanchions 168 are hollow and open to the axle interiors enabling fluid to flow to the interior of the roller 162. The interior of the stanchions 168 open to each other at a midpoint juncture 172 that is in fluid communication with the top plate 104. Accordingly, when the roller 162 is pressed onto the skin, reciprocation of the support tray 170 actuates the pump assembly 54, transferring fluid from the liner 60 through the stanchions 168 and into the roller 162 interior where the fluid passes through the porous roller material and is dispensed.

A cap 154 (FIG. 1) may be provided for covering the applicator assembly 56, including the top plate 104, when the fluid dispensing apparatus 50 is not in use. Features may be provided to enable the cap 154 to be attached, such as clips, flange edge, grooves, anchor points for latches, tabs, clips, magnets or other attachment means. The cap 154 may also be tethered to the housing 58. Similar attachment devices may also be used to enable the cap to be attached to the sides or bottom of the housing for temporary storage purposes. The cap 154 may also have indentations, bumps, ridges, or other surface shapes or textures to provide grip points for fingers in the process of cap removal and replacement and also aid in gripping when attached temporarily to the housing 58 during use. Such features may also include a flat surface that supports the housing 58 during the process of refilling.

In another embodiment, the cap 154 could be pivotally tethered in a central location such that the cap 154 can pivot on the tether and be snapped either over the applicator assembly 56 or on the housing 58 opposite the applicator assembly 56. In yet another embodiment, the cap 154 tether would be mounted to a member that slides in a track (not shown) from one end of the housing 58 to the other, thereby allowing the tether to be much shorter but still allowing the cap 154 to be placed by the user either over the applicator assembly 56 or on the housing 58 opposite the applicator assembly 56.

Referring to FIG. 2, to assemble the fluid dispensing apparatus 50, the liner 60 is positioned within the housing 58. The applicator assembly 56 is then mounted onto the housing 58 over the liner 60. In this arrangement, the pressurization chamber 74 fits into the opening 68 in the top wall 66 of the liner 60. The flange 70 on the liner 60 is sealed between the shoulder 72 in the outer end 64 of the housing 58 and the bottom surface of the top plate 104. Disassembly is the reverse of assembly, beginning with pulling the applicator assembly 56 from connection to the housing 58. The applicator assembly 56 may be further disassembled by removing the roller 110 from between the end walls 144 of the tray member 130. The applicator assembly 56 may be cleaned and the roller 110 replaced, if preferred.

In use, and referring to FIGS. 2 and 13-16, the user grasps the housing 58 and places the roller 110 in contact with an area of skin to be covered with fluid. The user then presses the roller 110 against the skin. The pressure applied on the roller 110 forces the connected upload tray 106 inwardly into the cavity 116 defined by the walls 114 of the top plate 104. As the upload tray 106 moves inwardly, the piston member 76 connected to the upload tray 106 is also moved inwardly relative to the pressurization chamber 74 and against the force of the spring 102. As the piston head 96 advances toward the inner wall of the pressurization chamber 74, the spring 102 is compressed between the piston head 96 and the stop valve 78 on the bottom of the pressurization chamber 74. Concurrently, the volume of the chamber 82 is reduced, generating positive pressure within the chamber. Due to the positive pressure in the chamber 82, the stop valve 78 is forced against the bottom of the pressurization chamber 74 sealing the intake ports 88. The fluid in the variable volume chamber 82 is forced through the port 94 and the hollow outer portion 90 of the piston member 76. The pressurized fluid moving through the piston member 76 opens the duckbill valve 80 at the outer end 91 of the piston member 76. The fluid exiting the duckbill valve 80 passes through the opening 134 in the support member 138 and the outlet port 140 onto the outer surface 138 of the tray member 130. The fluid is distributed laterally from the outlet port 140 along the channel 142 in the tray member 130 between the outer surface 138 of the tray member 130 and the roller 110. When the user moves the roller 110 along the skin, the roller rotates. The rotating roller 110 picks up the fluid and draws the fluid past the edge of the side walls 146 of the tray member where the fluid is screened to a uniform layer that is then delivered to the skin as the roller 110 continues to rotate further while making contact with the skin.

Figure 16:
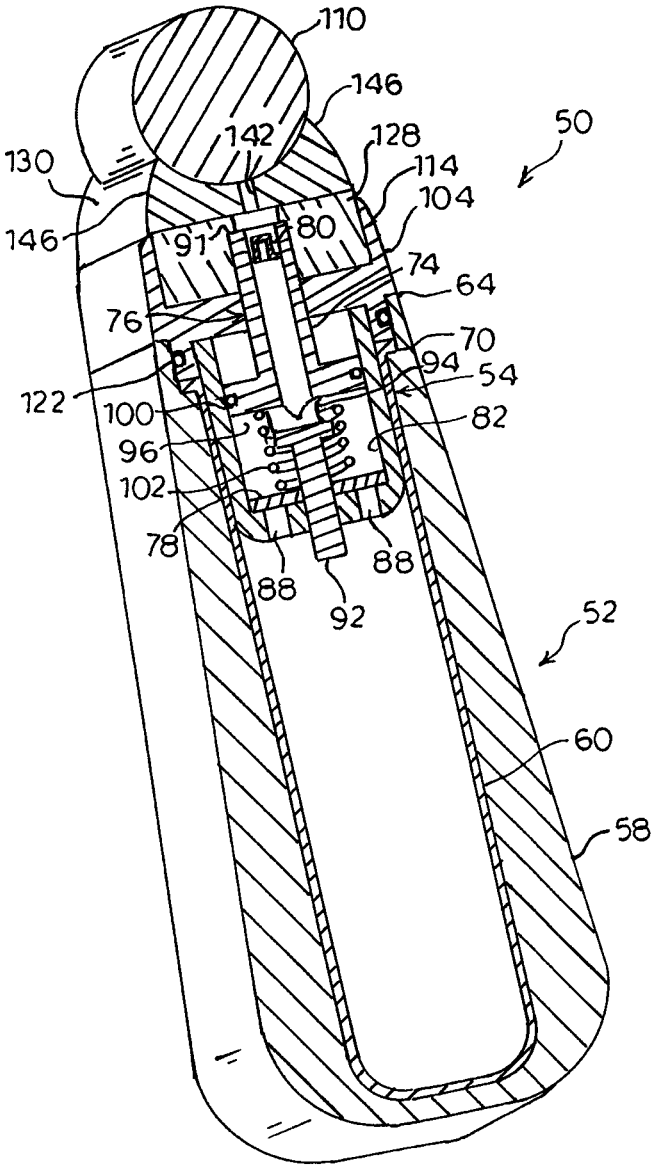
FIG. 16 is a transverse cross-section of the fluid dispensing apparatus as shown in FIG. 14 in a second position.

The upload tray 106 retains unused fluid in an area above the tray member 130 and beneath the roller 110 to reduce leakage that may otherwise result from excess fluid accumulating on the exposed surface of the applicator assembly 56. Such unused fluid is held in the tray member 130 awaiting transfer to the roller 110 during rotation. As shown in FIGS. 14 and 16, the edges of the side walls 146 of the tray member 130 are adjacent the roller 110. In use, the side walls 146 screen excess fluid from the rotating roller 110 when passing through a clearance between the side walls and the roller prior to dispensing fluid over the skin. The close fit of the roller 110 in the recess 148 of the tray member 130 helps provide a more uniform fluid coating on the roller 110 and reduces fluid buildup on the edges of the tray member 130. With this arrangement, fluid application to the skin is more efficient and reduces repetitive passage on the skin to place uniform layer of fluid.

When substantial pressure is released from the roller 110, though the roller 110 is not necessarily out of contact with the skin, the spring 102 returns the piston member 76 to the home position (FIGS. 13 and 15) with the piston head 96 against the inner surface of top plate 104 along with the upload tray 106 and roller 110 to their most outward position. This movement increases the volume of the chamber 82 and generates negative pressure within the pressurization chamber 74. Due to the negative pressure, the duckbill valve 80 closes preventing fluid and air from flowing back through the piston member 76. The negative pressure further causes the stop valve 78 to deform along its circumference for drawing fluid from the liner 60 into the chamber 82 through the intake ports 88 in the bottom wall of the pressurization chamber 74. The flexible liner 60 is deformable and contracts as fluid is drawn into the pressurization chamber 74. Air does not enter the liner 60, which enables inverted operation and eliminates the need to shake fluid into position to be taken up into the pressurization chamber 74 via the intake ports 88. One or more vent holes may be provided in the housing 58 to enable the liner 60 to more easily contract.

Thus, in response to roller 110 pressure against the skin, the pump assembly 54 is actuated for changing a volume of the chamber drawing fluid from the reservoir assembly 52 and dispensing the fluid onto the skin. The pressurization chamber 74 functions to draw fluid in increments from the liner 60 in quantities that vary based on user input. At the same time, the fluid is delivered to the skin as a consequence of the reciprocation of the applicator assembly 56 relative to the reservoir assembly 52 and rotation of the roller 110 in contact with the skin. A particular advantage of the pump assembly 54 is that piston operation in a rigid chamber can generate significant pressure based upon the input pressure received from the applicator assembly 56 being pressed onto a surface. This performance attribute is favorable in certain applications in which greater pumping pressures are demanded, such as for rapid delivery, or to deliver more viscous fluids. Another advantage of the pump assembly 54 is the piston reacts immediately to changes in input pressure from the applicator assembly 56 as contact is made with the surface. This attribute allows the user to closely regulate the amount of fluid flow at any time by changing the amount of input pressure. Still another advantage to the pump assembly 54 is that the pump assembly, inclusive of valves, ports, piston components and the spring, is contained within a single compact element. This minimizes the amount of space for the pumping operation, thereby increasing the amount of space available for fluid storage and for other components of the fluid dispensing apparatus 50.

It is preferred the applicator assembly 56 may make light contact with the skin without activating the flow of fluid. This operating feature is desirable to provide the user with the ability to use the applicator surface to spread fluid that has already been discharged onto the skin. Accordingly, the spring 102 is sufficiently resilient to resist light inward force of the applicator assembly 56 without actuating the flow of fluid.

Once the reservoir assembly 52 is empty, the liner 60 may be refilled. As described herein, the applicator assembly 56 and associated pump assembly 54 are integrated and detachable from the housing 58, which renders the reservoir assembly 52 easy to refill, clean, or replace. The liner 60 can remain in the housing 58 or be removed for refilling or replacement. Alternatively, the reservoir assembly 52 may incorporate a sealable refilling opening on a side of the housing 58 adjacent to or opposite the applicator assembly 56. The opening would have a sealing cap that attaches by means of screwing, snapping or other means of sealable capture. The cap may incorporate a tether to prevent it from being separated from the unit or a living hinge to allow pivotal attachment. The liner may also be replaced as a disposable element of the apparatus.

The fluid dispensing apparatus 50 may be used to apply, for example, sun screen or other body lotions. Other suitable fluids may include skin care compositions suitable for topical application, including, for example, shaving gels, lubricants, shaving foams, shaving lotions, shave oils, skin treatment compositions and creams, astringents, exfoliant scrubs, sun screens, cleansers, skin conditioning aids, ointments, imaging agents applied to the skin surface, depilatories, balms, lotions, moisturizers, fragrances, anesthetic lotions, and combinations thereof. Other fluids unrelated to personal care to be dispensed may include paints, adhesives, solvents, and other materials of a viscosity similar to that of commonly-used sun screens presently available. Further, other fluids with viscosities dissimilar to commonly-used sun screens may be delivered with the apparatus. This is possible by making readily apparent modifications in valves, ports, spring sizes, and other dimensions and materials of the apparatus as described.

Figure 18:
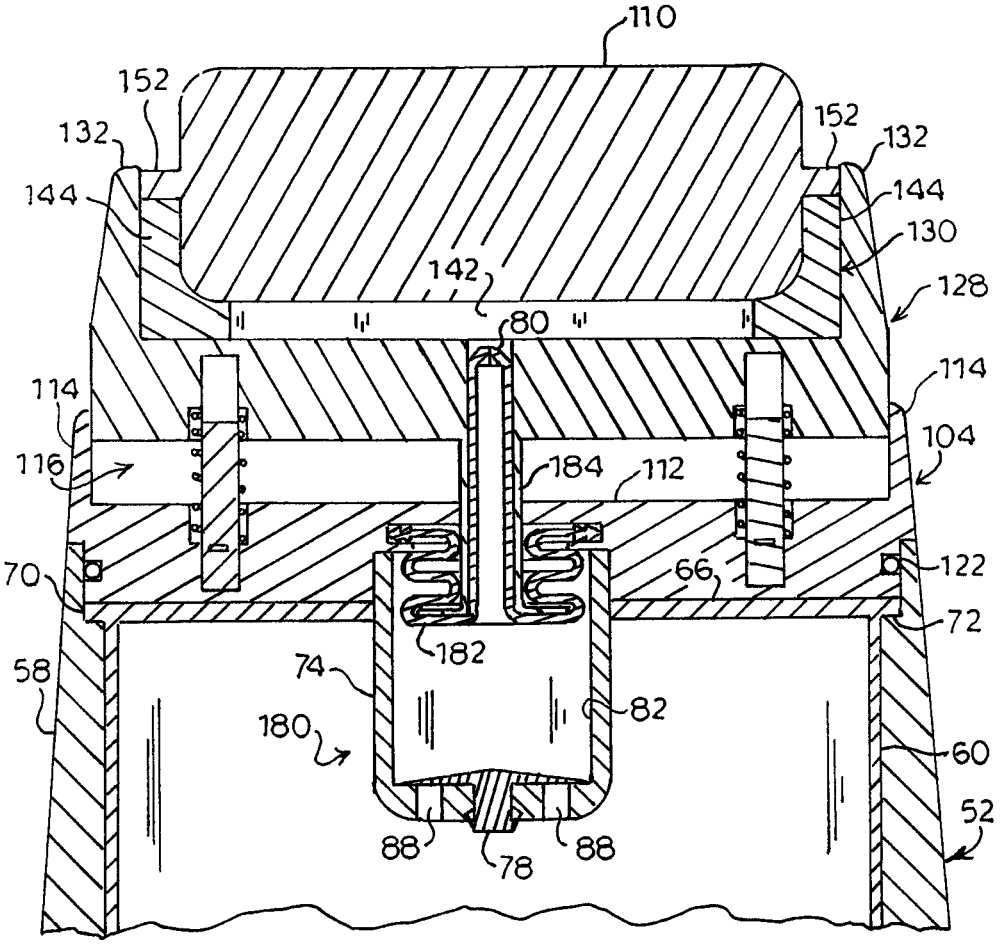
FIG. 18 is a longitudinal cross-section of another embodiment of a fluid transfer assembly for in a fluid dispensing apparatus as shown in FIG. 1 in a first position.
Figure 19:
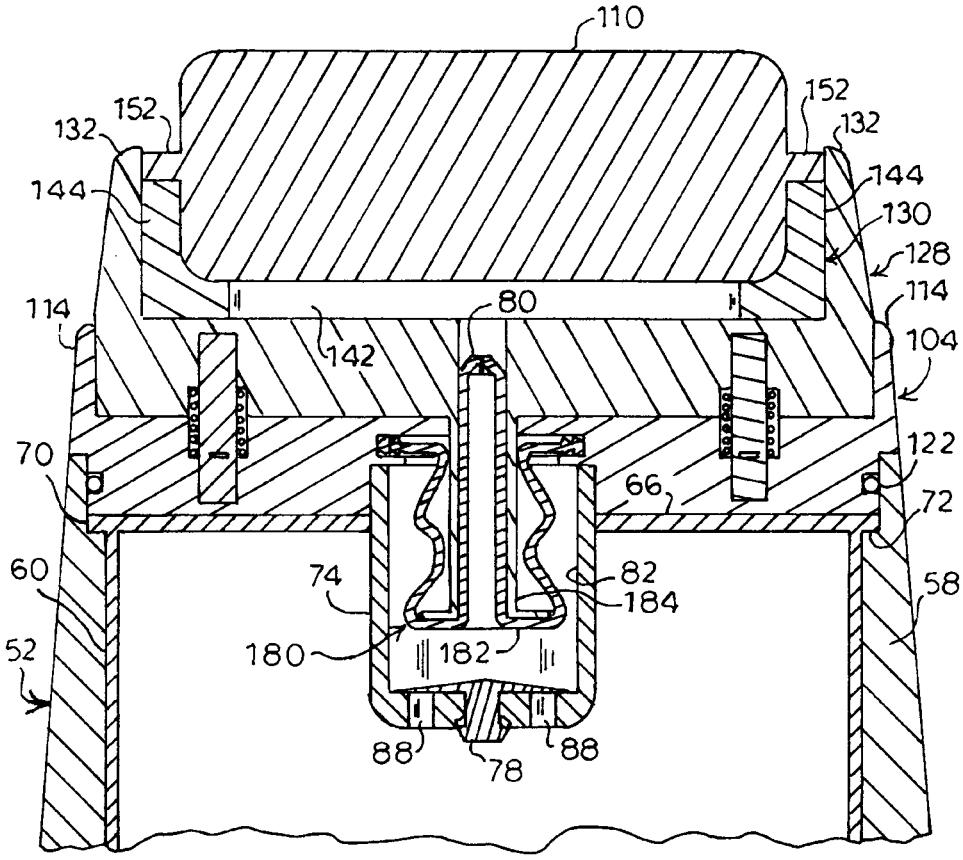
FIG. 19 is a longitudinal cross-section of another embodiment of a fluid transfer assembly for in a fluid dispensing apparatus as shown in FIG. 1 in a second position.

Referring to FIGS. 18 and 19, another embodiment of a pump assembly is shown and generally designated at 180. The pump assembly 180 comprises a bellows pump 182. A duckbill valve 80 is integral with the bellows pump 182. An outer wall of the bellows pump 182 is fixed relative to the top plate 104. A pump flange 184 extends inwardly into the bellows pump 182 from the upload tray 106. When the bellows pump 182 is extended into the pressurization chamber 74, the bellows pump 182 displaces a volume of fluid through the duckbill valve 80. The displacement of the fluid is thus accomplished without the resistance of the other embodiment of the pump assembly 54, thus reducing the force necessary to displace fluid by means of a linear motion. In another embodiment, the fluid dispensing apparatus 50 may be configured such that it does not include a reservoir assembly 52 or a liner 60. In this embodiment, the fluid dispensing apparatus 50 is adapted to be easily attached to existing packages of fluid, such as bottles, tubes or containers that are already produced and sold as prefilled volumes of fluid. A one-way valve, such as a duckbill valve, would be incorporated into the receptacle that is to receive the prefilled package that would allow the internal pressure of the package to be equalized when fluid is withdrawn via the fluid delivery system. In an embodiment without a liner, the body would be sealed so that the fluid is contained directly within the outer device walls. A sealably attached cap would be incorporated for refilling the device. A duckbill valve or other one way valve would also be incorporated into the cap or the body of the device, thereby allowing air to be drawn into the unit when fluid is drawn out by the fluid dispensing apparatus 50.

Although the present invention has been shown and described in considerable detail with respect to only a few exemplary embodiments thereof, it should be understood by those skilled in the art that we do not intend to limit the invention to the embodiments since various modifications, omissions and additions may be made to the disclosed embodiments without materially departing from the novel teachings and advantages of the invention, particularly in light of the foregoing teachings. For example, an extension arm can be added as a fixed or detachable element to enable a longer reach of the fluid dispensing apparatus to desired application targets, such as the back. Moreover, the fluid dispensing apparatus can be made to dispense any fluid, such as paints, oils, and the like. Accordingly, we intend to cover all such modifications, omissions, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

We claim:

1. An apparatus for dispensing a fluid, the fluid dispensing apparatus comprising:

a housing defining an open interior;

a resilient liner adapted to hold the fluid, the liner configured to be at least partially disposed in the interior of the housing;

an applicator assembly for dispensing the fluid on the user's skin, the applicator assembly mounted on the housing, the applicator assembly including an actuator movable relative to the housing in a first direction and a second direction, and a fluid delivery element which is held in contact against skin of a user for applying the fluid onto the skin, the fluid delivery element supported on the actuator to be movable together with the actuator by varying contact pressure with the skin; and a pump assembly at least partially disposed in the housing, the pump assembly comprising a pump chamber having an inner surface defining an interior cavity for accommodating fluid, an end of the pump chamber configured to be in fluid communication with the liner and having at least one opening for receiving the fluid, and a piston member in fluid communication with the applicator assembly, the piston member operatively connected to the actuator of the applicator assembly and reciprocably disposed in the pump chamber for movement in a first direction toward the end of the housing and in a second opposite direction, the piston member including a hollow piston rod closed at an inner end and open at an outer end, the piston rod having a port intermediate the length of the piston rod opening into the interior of the piston rod, and a piston head mounted on the piston rod such that the port is between the piston head and the inner end of the piston rod, the piston head sealing against the inner surface of the pump chamber and defining a variable volume chamber between the piston head and the end of the pump chamber, wherein each movement of the actuator in the first direction reduces the volume of the variable volume chamber for generating positive pressure in the pump chamber and forcing fluid through the port in the piston member and to the applicator assembly for dispensing the fluid, and each movement of the piston member in the second direction increases the volume of the variable volume chamber and generates continuous negative pressure within the pump chamber for drawing fluid through the at least one opening in the end of the pump chamber and collapsing the liner.

2. An apparatus for dispensing a fluid, the fluid dispensing apparatus comprising:

a housing defining an open interior;

a resilient liner adapted to hold the fluid, the liner configured to be at least partially disposed in the interior of the housing;

a fluid transfer mechanism in fluid communication with the liner, the fluid transfer mechanism configured to transfer the fluid from the liner;

a valve disposed in a fluid flow path from the liner to the fluid transfer mechanism; and an applicator assembly for dispensing the fluid on the user's skin, the applicator assembly mounted on the housing in fluid communication with the fluid transfer mechanism, the applicator assembly including an actuator movable relative to the housing in a first direction and a second direction so as to activate the fluid transfer mechanism to transfer the fluid from the liner to the applicator assembly when the actuator is reciprocated, and a fluid delivery element which is held in contact against skin of a user for applying the fluid onto the skin, the fluid delivery element supported on the actuator to be movable together with the actuator by varying contact pressure with the skin, wherein the valve opens only when the actuator moves in the second direction for allowing fluid flow from the liner to the fluid transfer mechanism, and wherein each movement of the actuator in the second direction generates continuous negative pressure within the liner for drawing fluid from the liner via the flow path to the fluid transfer mechanism and collapsing the liner.

3. An apparatus for dispensing a fluid, the fluid dispensing apparatus comprising:

a housing defining an open interior;

a resilient liner adapted to hold the fluid, the liner configured to be at least partially disposed in the interior of the housing;

a fluid transfer mechanism in fluid communication with the liner, the fluid transfer mechanism configured to transfer the fluid from the liner;

an applicator assembly for dispensing the fluid on the user's skin, the applicator assembly mounted on the housing in fluid communication with the fluid transfer mechanism, the applicator assembly including an actuator movable relative to the housing in a first direction and a second direction so as to activate the fluid transfer mechanism to transfer the fluid from the liner to the applicator assembly when the actuator is reciprocated, and a fluid delivery element which is held in contact against skin of a user for applying the fluid onto the skin, the fluid delivery element supported on the actuator to be movable together with the actuator by varying contact pressure with the skin; and a valve disposed in a fluid flow path from the fluid transfer mechanism to the applicator assembly, wherein the valve opens only when the actuator moves in the first direction, and wherein each movement of the actuator in the second direction generates continuous negative pressure within the liner for drawing fluid through the fluid transfer mechanism and collapsing the liner.

4. The fluid dispensing apparatus as recited in claim 3, wherein the valve comprises a duckbill valve for permitting fluid flow through the valve only in response to pressurizing of fluid upstream of the valve such as by moving the actuator in the first direction.

5. An apparatus for dispensing a fluid, the fluid dispensing apparatus comprising:

a housing defining an open interior;

a resilient liner adapted to hold the fluid, the liner configured to be at least partially disposed in the interior of the housing;

a fluid transfer mechanism in fluid communication with the liner, the fluid transfer mechanism configured to transfer the fluid from the liner and comprising a pump defining a chamber and a plurality of fluid receiving ports in a generally radial array, the ports opening into the pump chamber;

an applicator assembly for dispensing the fluid on the user's skin, the applicator assembly mounted on the housing in fluid communication with the fluid transfer mechanism, the applicator assembly including an actuator movable relative to the housing in a first direction and a second direction so as to activate the fluid transfer mechanism to transfer the fluid from the liner to the applicator assembly when the actuator is reciprocated, and a fluid delivery element which is held in contact against skin of a user for applying the fluid onto the skin, the fluid delivery element supported on the actuator to be movable together with the actuator by varying contact pressure with the skin, wherein pressure is provided to chamber to the fluid for forcing fluid from the chamber under the positive pressure when the actuator moves in the first direction when the actuator and fluid delivery element are pressed by contact with the user's skin, and wherein each movement of the actuator in the second direction generates continuous negative pressure within the liner for drawing fluid through the fluid transfer mechanism and collapsing the liner.

6. The fluid dispensing apparatus as recited in claim 5, wherein fluid receiving ports are positioned symmetrically about a central axial opening through said pump.

7. The fluid dispensing apparatus as recited in claim 1, wherein the applicator assembly is removably mounted to the housing.

8. An apparatus for dispensing a fluid, the fluid dispensing apparatus comprising:

a housing defining an open interior;

a resilient liner adapted to hold the fluid, the liner configured to be at least partially disposed in the interior of the housing;

a fluid transfer mechanism in fluid communication with the liner, the fluid transfer mechanism configured to transfer the fluid from the liner; and an applicator assembly for dispensing the fluid on the user's skin, the applicator assembly mounted on the housing in fluid communication with the fluid transfer mechanism, the applicator assembly including an actuator movable relative to the housing in a first direction and a second direction so as to activate the fluid transfer mechanism to transfer the fluid from the liner to the applicator assembly when the actuator is reciprocated, the actuator comprising a tray member for temporarily storing the fluid supplied from fluid transfer mechanism, the tray member having at least one elongated aperture in fluid communication with the fluid transfer mechanism, and a fluid delivery element which is held in contact against skin of a user for applying the fluid onto the skin, the fluid delivery element supported on the actuator to be movable together with the actuator by varying contact pressure with the skin, wherein the aperture extends along the longitudinal axis of the fluid delivery element for communicating fluid to the fluid delivery element, wherein each movement of the actuator in the second direction generates continuous negative pressure within the liner for drawing fluid through the fluid transfer mechanism and collapsing the liner.

9. The fluid dispensing apparatus as recited in claim 8, wherein the tray member comprises a pair of spaced walls, each wall having a tapered outer surface that tapers toward the inner edge of the spaced wall.

10. The fluid dispensing apparatus as recited in claim 1, wherein the fluid delivery element comprises a roller assembly, including a roller rotatably mounted to actuator.

11. The fluid dispensing apparatus as recited in claim 1, wherein the roller is made of an elastic material.

12. The fluid dispensing apparatus as recited in claim 11, wherein the applicator comprises means for mounting the roller, the roller mounting means comprising a pair of resilient spaced arms formed integrally of said head, whereby the roller may be assembled or disassembled by manually spreading the arms, and a pair of spaced walls spanning between and interconnecting the spaced arms, each wall having a tapered outer surface that tapers toward the inner edge of the spaced wall.

13. The fluid dispensing apparatus as recited in claim 1, wherein the housing has an exposed compressible surface for delivering the fluid disposed within the housing to the applicator assembly by manually squeezing the housing.

14. The fluid dispensing apparatus as recited in claim 1, wherein the pump is a resilient tubular element.

15. A fluid transfer assembly for use with an apparatus for dispensing a fluid, the fluid dispensing apparatus including a source of fluid and a reciprocating applicator assembly for dispensing the fluid on skin of a user, the fluid transfer assembly comprising:

a housing having an inner surface defining an interior cavity for accommodating the fluid, an end of the housing adapted to be in fluid communication with the source of fluid and having at least one opening for receiving the fluid; and a piston member adapted to be in fluid communication with the applicator assembly, the piston member adapted to be operatively connected to the applicator assembly and reciprocably disposed in the housing for movement in a first direction toward the end of the housing and in a second opposite direction, the piston member including a hollow piston rod closed at an inner end and open at an outer end, the piston rod having a port intermediate the length of the piston rod opening into the interior of the piston rod, and a piston head mounted on the piston rod such that the port is between the piston head and the inner end of the piston rod, the piston head sealing against the inner surface of the housing and defining a variable volume chamber between the piston head and the end of the housing, wherein each movement of the piston member in the first direction reduces the volume of the variable volume chamber for generating positive pressure in the chamber and forcing fluid through the port in the piston member and to the applicator assembly, and each movement of the piston member in the second direction increases the volume of the variable volume chamber for generating negative pressure within the chamber for drawing fluid through the at least one opening in the end of the housing.

16. A fluid transfer assembly for use with an apparatus for dispensing a fluid, the fluid dispensing apparatus including a source of fluid and a reciprocating applicator assembly for dispensing the fluid on skin of a user, the fluid transfer assembly comprising:

a housing defining an interior cavity for accommodating the fluid, an end of the housing adapted to be in fluid communication with the source of fluid and having at least one opening for receiving the fluid;

a piston member defining a through passage and in fluid communication with the applicator assembly, the piston member adapted to be operatively connected to the applicator assembly and reciprocably disposed in the housing for movement in a first direction toward the end of the housing and in a second opposite direction, the piston member and the housing defining a variable volume chamber between the piston member and the end of the housing; and a valve disposed in a fluid flow path from the fluid source through the at least one opening to the variable volume chamber, wherein the valve opens only when the piston member moves in the second direction for allowing fluid flow from the fluid source to the chamber, wherein each movement of the piston member in the first direction reduces the volume of the variable volume chamber for generating positive pressure in the chamber and forcing fluid through the through passage in the piston member and to the applicator assembly, and each movement of the piston member in the second direction increases the volume of the variable volume chamber for generating negative pressure within the chamber for drawing fluid via the flow path through the at least one opening in the end of the housing.

17. A fluid transfer assembly for use with an apparatus for dispensing a fluid, the fluid dispensing apparatus including a source of fluid and a reciprocating applicator assembly for dispensing the fluid on skin of a user, the fluid transfer assembly comprising:

a housing defining an interior cavity for accommodating the fluid, an end of the housing adapted to be in fluid communication with the source of fluid and having at least one opening for receiving the fluid;

a piston member defining a through passage and in fluid communication with the applicator assembly, the piston member adapted to be operatively connected to the applicator assembly and reciprocably disposed in the housing for movement in a first direction toward the end of the housing and in a second opposite direction, the piston member and the housing defining a variable volume chamber between piston member and the end of the housing; and a valve disposed in a fluid flow path through the through passage in the piston member to the applicator assembly, wherein the valve opens only when the piston member moves in the first direction, wherein each movement of the piston member in the first direction reduces the volume of the variable volume chamber for generating positive pressure in the chamber and forcing fluid through the through passage in the piston member and via the flow path to the applicator assembly, and each movement of the piston member in the second direction increases the volume of the variable volume chamber for generating negative pressure within the chamber for drawing fluid through the at least one opening in the end of the housing.

18. The fluid transfer assembly as recited in claim 17, wherein the valve comprises a duckbill valve for permitting fluid flow through the valve only in response to pressurizing of fluid upstream of the valve such as by moving the piston member in the first direction.

19. A fluid applicator assembly for use with an apparatus for dispensing a fluid, the fluid dispensing apparatus including a source of fluid and a fluid transfer assembly in fluid communication with the fluid source for delivering fluid to the fluid applicator assembly, the fluid applicator assembly comprising:

a tray member adapted to be in fluid communication with the fluid transfer assembly, the tray member comprising a pair of spaced walls, each wall tapered to an inner edge surface for defining a recess for temporarily storing the fluid supplied from the fluid transfer assembly, each one of the pair of walls having a tapered outer surface that tapers toward the inner edge of the wall, and means for mounting the roller, the roller mounting means including a pair of resilient spaced arms, each one of the arms spanning between and interconnecting the spaced walls; and a roller assembly, including a roller rotatably mounted to the spaced arms for contacting skin of a user for applying the fluid onto the skin, wherein the roller may be attached to the tray member or removed from the tray member by manually spreading the arms.

20. The fluid applicator assembly as recited in claim 19, wherein the roller is made of an elastic material.

21. The fluid applicator assembly as recited in claim 19, wherein the tray member has at least one elongated aperture in fluid communication with the fluid transfer assembly, the aperture extending along the longitudinal axis of the tray member for communicating fluid to the roller.

22. A method for dispensing a fluid, comprising the steps of:

providing a fluid dispensing apparatus, including a housing defining an open interior;

a resilient liner adapted to hold the fluid, the liner configured to be at least partially disposed in the interior of the housing;

an applicator assembly for dispensing the fluid on the user's skin, the applicator assembly mounted on the housing, the applicator assembly including an actuator movable relative to the housing in a first direction and a second direction, and a fluid delivery element which is held in contact against skin of a user for applying the fluid onto the skin, the fluid delivery element supported on the actuator to be movable together with the actuator by varying contact pressure with the skin; and a pump assembly at least partially disposed in the housing, the pump assembly comprising a pump chamber having an inner surface defining an interior cavity for accommodating fluid, an end of the pump chamber configured to be in fluid communication with the liner and having at least one opening for receiving the fluid, and a piston member in fluid communication with the applicator assembly, the piston member operatively connected to the actuator of the applicator assembly and reciprocably disposed in the pump chamber for movement in a first direction toward the end of the housing and in a second opposite direction, the piston member including a hollow piston rod closed at an inner end and open at an outer end, the piston rod having a port intermediate the length of the piston rod opening into the interior of the piston rod, and a piston head mounted on the piston rod such that the port is between the piston head and the inner end of the piston rod, the piston head sealing against the inner surface of the pump chamber and defining a variable volume chamber between the piston head and the end of the pump chamber, wherein each movement of the actuator in the first direction reduces the volume of the variable volume chamber for generating positive pressure in the pump chamber and forcing fluid through the port in the piston member and to the applicator assembly for dispensing the fluid, and each movement of the piston member in the second direction increases the volume of the variable volume chamber and generates continuous negative pressure within the pump chamber for drawing fluid through the at least one opening in the end of the pump chamber and collapsing the liner;

contacting the skin of a user with the fluid delivery element;

pressing the fluid delivery element against the skin of the user for moving the actuator in the first direction; and releasing pressure of the fluid delivery element against the skin of the user for allowing the actuator to move in the second direction.

* * * * *